US006042641A

United States Patent [19]

Justice

[11] Patent Number: 6,042,641

[45] Date of Patent: Mar. 28, 2000

[54] CB PRINTING INK

[75] Inventor: William N. Justice, Waverly, Ohio

[73] Assignee: The Mead Corporation, Dayton, Ohio

[21] Appl. No.: 09/173,909

[22] Filed: Oct. 16, 1998

[51] Int. Cl.[7] ..... C09D 11/02

[52] U.S. Cl. ..... 106/31.16; 106/31.25; 106/31.26

[58] Field of Search ..... 106/31.16, 31.25, 106/31.26

[56] References Cited

U.S. PATENT DOCUMENTS

| | | | |
|---|---|---|---|
| 3,511,693 | 5/1970 | Davidson | 117/102 |
| 3,635,747 | 1/1972 | Skees et al. | 117/26.3 |
| 3,849,170 | 11/1974 | Mays et al. | 117/26.3 |
| 4,060,262 | 11/1977 | Maierson | 282/27.5 |
| 4,077,824 | 3/1978 | Paulson et al. | 156/244.24 |
| 4,140,335 | 2/1979 | Paulson et al. | 282/27.5 |
| 4,234,213 | 11/1980 | Skees | 282/27.5 |
| 4,312,268 | 1/1982 | King et al. | 101/1 |
| 4,321,093 | 3/1982 | Seitz | 106/21 |
| 4,337,968 | 7/1982 | Maierson | 282/27.5 |
| 4,360,262 | 11/1982 | Genthe | 355/3 CH |
| 4,398,954 | 8/1983 | Stolfo | 106/21 |
| 4,531,139 | 7/1985 | Seitz | 346/201 |
| 4,556,687 | 12/1985 | Maierson | 524/333 |
| 4,614,757 | 9/1986 | Maierson | 524/333 |
| 4,623,391 | 11/1986 | Seitz | 106/21 |
| 4,729,792 | 3/1988 | Seitz | 106/21 |
| 4,738,898 | 4/1988 | Vivant | 106/31.16 |
| 4,889,877 | 12/1989 | Seitz | 523/161 |
| 4,898,780 | 2/1990 | Seitz | 106/31.16 |
| 4,940,738 | 7/1990 | Seitz | 523/161 |
| 4,940,739 | 7/1990 | Seitz | 523/161 |
| 4,985,484 | 1/1991 | Yushida et al. | 524/379 |
| 5,002,924 | 3/1991 | Seitz | 503/207 |
| 5,017,225 | 5/1991 | Nakanishi et al. | 106/21 |
| 5,069,831 | 12/1991 | Schwab | 264/4.33 |
| 5,084,492 | 1/1992 | Pinell et al. | 523/161 |
| 5,102,856 | 4/1992 | Doll et al. | 503/209 |
| 5,132,271 | 7/1992 | Seitz | 503/213 |
| 5,156,675 | 10/1992 | Breton et al. | 106/22 |
| 5,169,826 | 12/1992 | Seitz et al. | 503/207 |
| 5,271,958 | 12/1993 | Szczepanski et al. | 427/150 |
| 5,286,286 | 2/1994 | Winnik et al. | 106/21 A |
| 5,330,959 | 7/1994 | Raby et al. | 503/201 |
| 5,458,974 | 10/1995 | Earhart et al. | 106/311 |
| 5,478,380 | 12/1995 | Templey et al. | 106/31.16 |
| 5,489,332 | 2/1996 | Earhart et al. | 106/31.16 |

FOREIGN PATENT DOCUMENTS

| | | | |
|---|---|---|---|
| 939410 | 1/1974 | Canada | 282/16 |
| 939698 | 1/1974 | Canada | 282/2 |
| 939699 | 1/1974 | Canada | 282/15 |
| 0037477 | 3/1981 | European Pat. Off. | B41M 5/00 |
| 0223428 | 10/1986 | European Pat. Off. | B01J 13/02 |
| 4235788A1 | 4/1994 | Germany | C09D 11/08 |
| 1091077 | 11/1967 | United Kingdom | B65D 85/00 |
| 1400203 | 7/1975 | United Kingdom | B01J 13/02 |
| WO95/02643 | 1/1995 | WIPO | C09D 11/02 |

OTHER PUBLICATIONS

Abstract of Japanese Patent No. JP 10044594A, Feb. 1998.
Copy of English translation of WO 95/02643, Jan. 1995.
Brief discussion of the relevancy of DE 4235788 A1 (taken from p. 1 of the translation of WO 95/02543), no date available.

*Primary Examiner*—Helene Klemanski
*Attorney, Agent, or Firm*—Thompson Hine & Flory LLP

[57] ABSTRACT

A method for producing a printing ink containing microcapsules which is suitable for application from an offset printing tower which comprises preparing a capsule slurry containing at least 45% by weight total solids and mixing the slurry under high shear with a printing ink vehicle containing not more than 15% by weight oil.

23 Claims, 1 Drawing Sheet

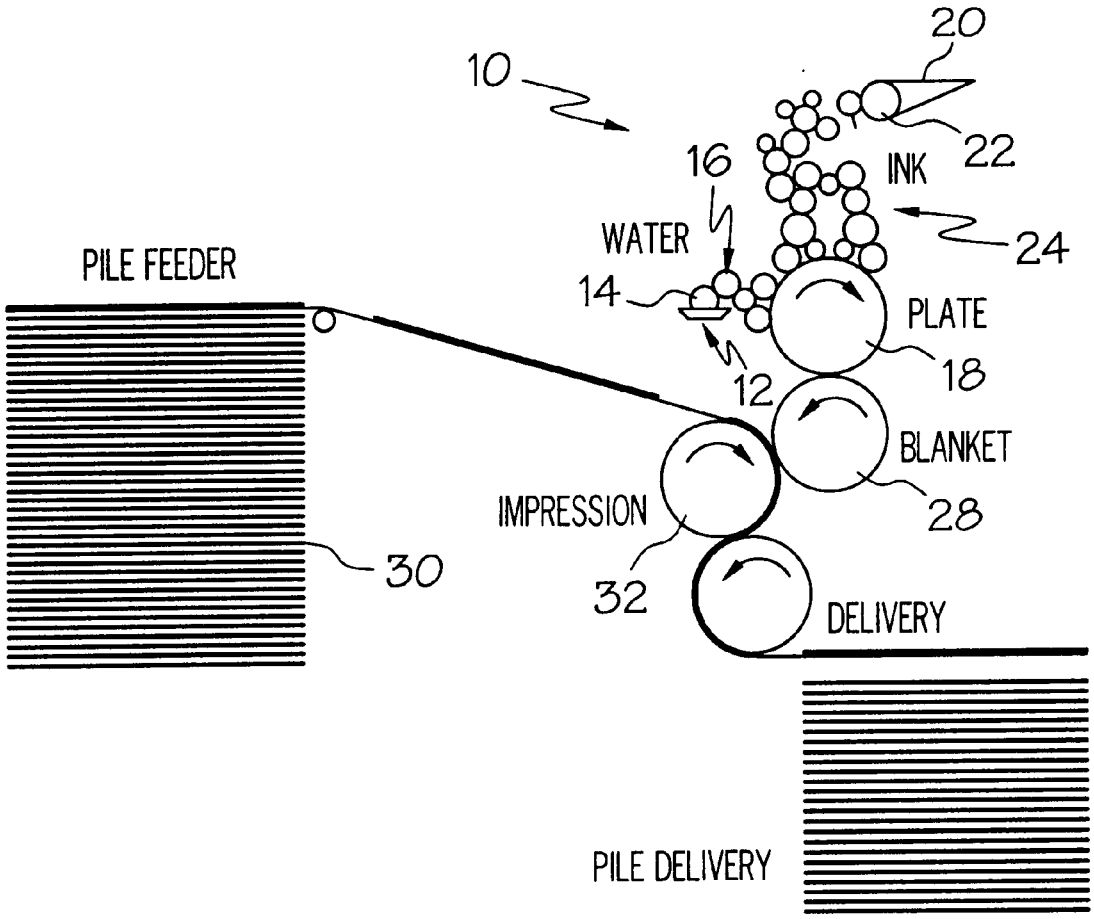
10
20
22
INK
16
WATER
24
PILE FEEDER
14
PLATE
18
12
BLANKET
28
IMPRESSION
30
32
DELIVERY
PILE DELIVERY

CB PRINTING INK

BACKGROUND

The present invention relates to a printing ink containing microcapsules which has the consistency of a paste and is suitable for use in the manufacture of business forms by application from the ink fountain tray of a dry offset printing tower.

In pressure-sensitive recording papers, more commonly referred to as carbonless copy papers, a layer of pressure-rupturable microcapsules containing a solution of colorless dyestuff precursor (the color former) is coated on the back side of the front sheet of paper in a form set. This backside coating is known as the CB coating and the sheet carrying it is known as the CB sheet. In order to form an image the CB coating is mated with a paper coated with a suitable color developer on its front side. This coating is known as a CF coating and the sheet is known as the CF sheet. Marks are made by rupturing the capsules in the CB coating by pressure to cause the color former to release from the capsules and react with the developer whereupon the color former is converted to its colored form and the mark is formed.

The Mead Corporation pioneered the development of compositions containing microcapsules which are suitable for on press application in the manufacture of business forms. These compositions are characterized by their ability to set rapidly, with minimal drying, so that they can be applied to the forms at the printing speeds normally encountered on a forms press. One of the compositions which Mead continues to commercialize is a hot melt composition in which the microcapsules are incorporated into a coating composition containing a wax binder. Other printing ink compositions have also been developed which are aqueous based compositions but which contain minimal amounts of water so that they can meet the drying speed requirements for application on a forms press. One such composition is described in U.S. Pat. No. 4,889,877 to Seitz and utilizes a slurry of microcapsules which is prepared by microencapsulating the color former in situ in a printing ink vehicle. Another composition described in International Patent Application WO 95/02643 is prepared by spray drying the microcapsules and adding the spray dried capsules to a printing ink vehicle. The compositions which have been developed to date have been designed for application from the dampening system tray but they are not suitable for application from the ink fountain tray of a dry offset printing tower because they are not viscous enough. The printing ink compositions applied from the ink fountain tray must have the consistency of a paste.

SUMMARY OF THE INVENTION

One manifestation of the invention is a CB printing ink paste which comprises a printing ink vehicle containing less than about 15% by weight oil, and an aqueous slurry of microcapsules containing at least 45% by weight total solids (i.e., the slurry contains less than 55% water) wherein the printing ink vehicle and the aqueous slurry of microcapsules are mixed under high shear to form a water-in-oil emulsion. The CB printing ink has a viscosity greater than 50,000 cps and preferably greater than 100,000 cps. The invention also provides a method for preparing a CB printing ink paste which comprises preparing an aqueous slurry of microcapsules containing at least 45% total solids, emulsifying the aqueous slurry of microcapsules into a printing ink vehicle which contains less than 15% oil under high shear to form a homogenous water-in-oil emulsion. In one embodiment, the microcapsule slurry is prepared using a nonaqueous diluent as described in more detail in U.S. Pat. No. 4,889,877. A still further manifestation of the invention is a process for preparing carbonless forms wherein the aforesaid printing ink is applied to a forms web and, more particularly, applied from an offset ink tower.

BRIEF DESCRIPTION OF THE DRAWING

The FIGURE is a schematic illustration of an offset printing tower 10 showing the water fountain tray 12 in which a water fountain roller 14 delivers water via roller train 16 to a printing plate 18. Ink from ink fountain tray 20 is supplied to plate 18 by the ink fountain roller 22 and roller train 24. Paper from stack 30 is printed as it passes between blanket 28 and impression roller 32. The compositions of the invention are characterized in that they are formulated such that the viscosity of the compositions is high enough that they have the paste like consistency required for application from the ink fountain tray 20.

DETAILED DESCRIPTION OF THE INVENTION

The paste is formulated so that it can be supplied to an ink fountain tray in a conventional offset printing tower and applied to a paper web on a conventional forms press. For this purpose, the ink has a viscosity of at least 70,000 cps, more preferably at least 90,000 cps and still more preferably at least 150,000 cps.

The patent literature describes various methods for preparing aqueous slurries of microcapsules including coacervation, in situ polymerization, interfacial polymerization of one or more monomers in an oil, as well as various melting, dispersing and cooling methods. Compounds which have been found preferable for use as wall forming compounds in the various microencapsulation techniques included: hydroxypropylcellulose, methylcellulose, carboxymethylcellulose, gelatin, melamineformaldehyde, polyfunctional isocyanates and prepolymers thereof, polyfunctional acid chlorides, polyamines, polyols, epoxides and mixtures thereof. The microencapsulation method which is preferred is an interfacial polymerization wherein a reactant, preferably a crosslinking agent such as a polyisocyanate, is dissolved in an oily solution which will serve as the internal phase of the microcapsules. Thus, for a CB ink, the oil solution will contain an oily solvent and a dye precursor(s) capable of reacting with a color developer in order to form a color. The crosslinking agent is dissolved in that oil solution. The oil solution having the reactant dissolved therein is, then, dispersed into an aqueous solution to form an emulsion. A coreactant such as a polyamine or a polyol is added either before or after emulsification. In any event, as is known, the reactant and coreactant react in the emulsion by an interfacial polymerization or interfacial crosslinking mechanism to form a hard thick capsule wall around droplets of the oily solution and produce microcapsules. Microcapsules formed by interfacial polymerization having walls formed from polyurea polymer are preferred because they are able to withstand the high shear conditions necessary to emulsify the microcapsules into the printing ink vehicle and form the water-in-oil emulsion which characterizes the printing ink. A preferred polyurea wall is formed by reacting aliphatic polyisocyanates such as 1,6-hexamethylene diisocyanate with multi-functional amines such as DETA (diethylenetriamine) or guanidine.

In order to achieve the desired viscosity in the printing ink, the aqueous slurry of microcapsules is concentrated or prepared under conditions which yield a slurry concentration of at least 45% and typically about 50 to 70% total solids. If necessary, filtration and decantation techniques can be used to obtain the desired concentration. In one embodiment of the invention, a non-volatile diluent is used as a co-solvent with water as the continuous phase for encapsulation as disclosed in detail in U.S. Pat. No. 4,889,877 to Seitz. The non-volatile diluent should be soluble in water (i.e., greater than about 33% solubility in water), immiscible in the oily solution, non-reactive with the reactant and coreactant capsule wall materials, and have a low viscosity (i.e., less than approximately 50 cps). Preferably, the non-volatile diluent should also be relatively non-hygroscopic, not be a plasticizer for the capsule wall, have a vapor pressure of less than about 0.1 mm Hg, and be essentially tack free when dried. The preferred non-volatile diluents are non-reducing sugars such as methyl glucoside, but other materials such as dimethyl urea, dimethyl hydantoin formaldehyde resin, and sorbitol, erythritol, and polyoxyethlene polyols such as Carbowax 4000 can be used. In the aqueous solution preferable there is found 24–40% water and 12–25% (most preferably 13–20%) non-volatile diluent.

The chromogenic color precursors most useful in the practice of this invention are the color precursors of the electron-donating type. The preferred group of electron donating color precursors include the lactone phthalides, such as crystal violet lactone, and 3,3-bis(1'-ethyl-2-methylindol-3"-yl) phthalide, the lactone fluorans, such as 2-dibenzylamino-6-diethylaminofluoran and 6-diethylamino-1,3-dimethylfluorans, the lactone xanthenes, the leucoauramines, the 2-(omega substituted vinylene)-3,3-disubstituted-e-H-indoles and 1,3,3-trialkylindolinospirans. Mixtures of these color precursors can be used if desired. In the preferred process of this invention microencapsulated oil solutions of color precursors are used. The color precursors are preferably present in such oil solutions in an amount of from about 0.5% to about 20.0% based on the weight of the oil solution, and the most preferred range is from about 2% to about 7%. Solvents for the color precursors are known in the art and include chlorinated paraffin, alkylated biphenyls and others. While a printing ink containing CB microcapsules as described above is the preferred form of present invention, the oil-containing microcapsules of the present invention may include substances other than dye precursors. For example, fragrances, insecticides, liquid crystals and other frequently encapsulated substances may also be used.

Conventional printing inks typically utilize a vehicle to disperse and carry the pigment. The printing ink vehicle facilitates transfer of the pigment to substrate. The vehicle is important in determining final ink film properties such as gloss and setting. Traditionally, such vehicles have been made from solvents, vegetable oils, resins and may include other components such as co-solvents, rheological modifiers, driers and anti-oxidants. Paste printing inks typically utilize a vehicle based upon petroleum distillates as the major solvent. Vegetable oils such as linseed oil, soy oil, canola oil, or tung oil have also been used as solvents in printing inks in place of the petroleum distillates. The solvent in the vehicle, in conjunction with any co-solvents, serves to keep the other components of the vehicle in solution and also functions as a tack reducer. In accordance with this invention the amount of these oils is held to not more than 15% by weight preferably 3–15% by weight of the vehicle.

The printing ink vehicle also typically contains a resin. The resin serves as a film forming agent and also contributes to finished ink properties such as tack, film integrity and cohesive properties. Conventional ink resins include those derived from rosin, in particular, esters of rosin and modified rosin, synthetic rosin modified hydrocarbon resins and cyclized rubber.

The vehicle may also contain rheological modifiers such as gelling agents to help lower the misting properties and to contribute to a faster setting ink. Furthermore, the theological modifiers serve to control the flow properties of the ink. The gelling agents are typically organometallic compounds of aluminum or polyamide resins.

The vehicle may also contain anti-oxidants and driers. Anti-oxidants retard auto-oxidation to prevent premature skinning of both the vehicle and the printing ink. Examples of such anti-oxidants are butylated hydroxy toluene (BHT) or hydroquinone. Driers are added to aid in the oxidation drying of the ink film. Examples of driers include metal salts of acylates and metal salts of octoates.

One example of a printing ink vehicle useful in the present invention is provided in the table below:

| | % | function |
|---|---|---|
| Magiesol 62 | 10.74 | carrier/solubilizer |
| Hexadecanol | 3.60 | emulsifier aid |
| Versaflow | 0.50 | lubricant |
| Pentalyn H. Resin | 22.41 | binder |
| Polywax | 1.75 | plasticizer |
| Claytone HY | 1.00 | rheology aid |

The method of dispersing the microcapsules in the ink vehicle is important since it is, likewise, necessary to use a process which mixes the slurry of microcapsules and the viscous ink vehicle under high shear to produce water-in-oil emulsion. In accordance with one embodiment of the invention, a high shear mixing device such as a Cowles mixer is used. Other high shear mixers may also be used to produce the water-in-oil emulsion.

In the preferred application of the process and products of this invention a manifold carbonless form is produced. In this process a continuous web is marked with a pattern on at least one surface. The printing ink is applied to at least a portion of at least one surface of the continuous web. A manifold carbonless form is then made by a variety of collating and finishing steps.

The chromogenic coating composition can be applied to a substrate, such as paper or a plastic film by any of the common paper coating processes as developed above such as roll, blade coating or by any of the common printing processes, such as gravure, or flexographic printing. The rheological properties, particularly the viscosity of the coating composition, can be adjusted for each type of application. The compositions are especially suitable for application by offset printing. While the actual amount of the ink applied to the substrate can vary depending on the particular final product desired, for purposes of coating paper substrates CB coat weight of from about 2 grams to about 12 grams per square meter of substrate have been found practical. The preferred range of CB coat weight application is from about 3 grams to about 7 grams per square meter of substrate, while the most preferred range is from about 4 grams to about 6 grams per square meter of substrate.

The ink composition can be made by emulsifying up to 70% and typically about 40 to 70% by weight of the aqueous microcapsule slurry with at least 3% and typically about 30 to 60% by weight of the ink vehicle. The composition of the ink, as previously noted, should have a viscosity of at least 90,000 cps. Generally compositions based on 60% capsule slurry and 40% of the ink vehicle are preferred. Compositions containing as little as 40% of the capsule slurry may produce marks that are useful but somewhat light. Compositions which contain as much as 70% of the slurry have been observed to build up undesirably in the ink roller train. In order to achieve rapid setting with minimal drying time, the ink should contain no more than about 40% by weight water. The composition preferably contains about 20 to 30% microcapsules (dry weight).

Having described the invention in detail and with reference to particular embodiments thereof, those skilled in the art will appreciate that numerous modifications and variations are possible without departing from the spirit and scope of the invention as defined by the appended claims.

I claim:

1. A method for producing a printing ink containing microcapsules which is suitable for application from an offset printing tower which comprises:

preparing a capsule slurry containing at least 45% by weight total solids and mixing said slurry under high shear with a printing ink vehicle containing not more than 15% by weight oil.

2. The method of claim 1 wherein said capsule slurry contains up to 70% by weight total solids and said printing ink vehicle contains about 3 to 15% by weight oil.

3. The method of claim 2 wherein said slurry and said vehicle are selected and mixed in amounts such that said printing ink has a viscosity greater than 70,000 cps.

4. The method of claim 3 wherein said printing ink has a viscosity of about 90,000 cps to 150,000 cps.

5. The method of claim 4 wherein said microcapsules have polyurea walls.

6. The method of claim 1 wherein about 40 to 70% by weight of said slurry is mixed with about 60 to 30% by weight of said printing ink vehicle.

7. The method of claim 1 wherein said microcapsules contain a color precursor(s).

8. The method of claim 1 wherein said microcapsules contain fragrance(s).

9. The method of claim 1 wherein said mixing step is performed using a high shear mixer.

10. The method of claim 5 wherein said microcapsules are prepared by reacting aliphatic polyisocyanates with multifunctional amines.

11. A CB printing ink paste comprising a water-in-oil emulsion of an aqueous slurry of microcapsules in a printing ink vehicle, said slurry of microcapsules containing at least 45% by weight total solids and said vehicle containing not more than 15% by weight oil.

12. The paste of claim 11 wherein said capsule slurry contains up to 70% by weight total solids and said printing ink vehicle contains about 3 to 15% by weight oil.

13. The paste of claim 12 wherein said paste has a viscosity of at least 70,000 cps.

14. The paste of claim 13 wherein said paste has a viscosity of about 90,000 to 150,000 cps.

15. The paste of claim 14 wherein said microcapsules have polyurea walls.

16. The paste of claim 15 wherein said walls are the reaction product of aliphatic polyisocyanates and multifunctional amines.

17. The paste of claim 11 wherein said microcapsules contain a color precursor(s).

18. The paste of claim 11 wherein said paste contains fragrance(s).

19. A method for preparing a carbonless form which comprises applying a printing ink paste to a paper web, said paste being a water-in-oil emulsion of an aqueous slurry of microcapsules containing a color precursor(s) in a printing ink vehicle, said slurry containing at least 45% by weight total solids and said vehicle containing not more than 15% by weight oil.

20. The method of claim 1 wherein said slurry of microcapsules is prepared by emulsifying an oily internal phase in a continuous phase containing water and a nonaqueous diluent.

21. The CB printing ink paste of claim 11 wherein said slurry of microcapsules is prepared by emulsifying an oily internal phase in a continuous phase containing water and a nonaqueous diluent.

22. The method of claim 19 wherein said slurry of microcapsules is prepared by emulsifying an oily internal phase in a continuous phase containing water and a nonaqueous diluent.

23. The method of claim 19 wherein said paste is provided to said web from an ink fountain tray of a dry offset tower.

* * * * *